United States Patent [19]

Talalay

[11] 4,063,367

[45] Dec. 20, 1977

[54] METHOD OF AND APPARATUS FOR DRYING LIQUID FROM A LIQUID-SOLID COMPOSITE AND SEALING THE REMAINING SOLID MATERIAL

[76] Inventor: Leon Talalay, 1 Chestnut Lane, Woodbridge, Conn. 06525

[21] Appl. No.: 617,667

[22] Filed: Sept. 29, 1975

[51] Int. Cl.[2] ..... F26B 5/04

[52] U.S. Cl. ..... 34/15; 34/92; 53/7; 53/22 R

[58] Field of Search ..... 34/5, 15, 51, 92; 53/7, 53/22 R, 22 A

[56] References Cited

U.S. PATENT DOCUMENTS

| | | | |
|---|---|---|---|
| 2,763,107 | 9/1956 | Day et al. | 53/7 |
| 3,384,978 | 5/1968 | Cox | 34/92 |
| 3,498,018 | 3/1970 | Seiferth et al. | 53/22 R |
| 3,552,030 | 1/1971 | Jason et al. | 34/15 X |

*Primary Examiner*—John J. Camby

*Attorney, Agent, or Firm*—DeLio and Montgomery

[57] ABSTRACT

A liquid-solid composite which may be biologically active is placed in a container and subjected to passage of relatively high velocity dry air over the surface of the composite to remove moisture therefrom, thereafter the container is subjected to vacuum to remove any residual moisture and then subjected to an inert atmosphere, and sealed therein.

15 Claims, 7 Drawing Figures

Fig. 6
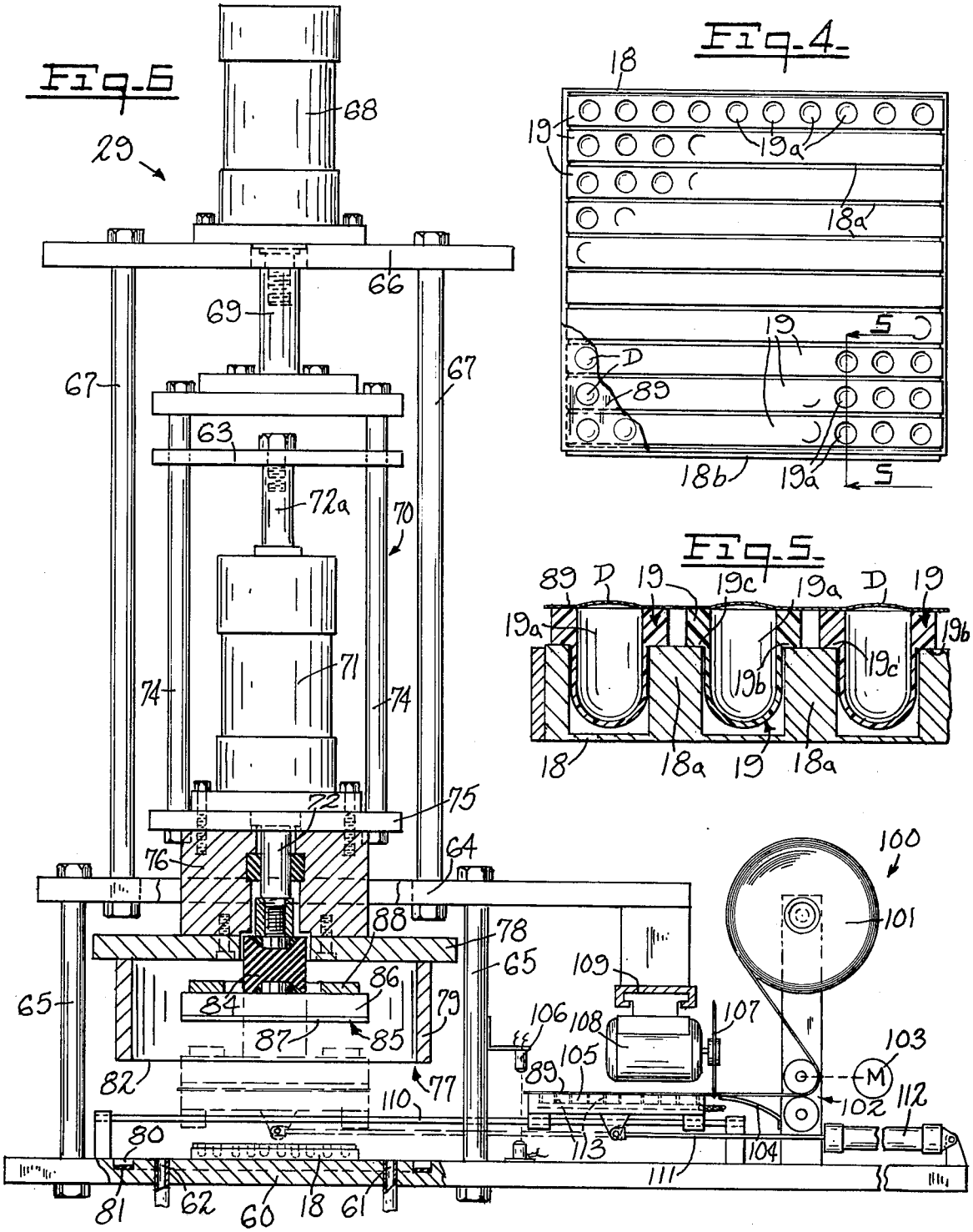
Fig. 4
Fig. 5
Fig. 7
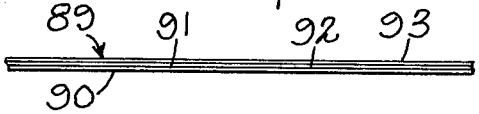

METHOD OF AND APPARATUS FOR DRYING LIQUID FROM A LIQUID-SOLID COMPOSITE AND SEALING THE REMAINING SOLID MATERIAL

This invention relates to the dehydration of liquid-solid composites so that the resulting solid may be stored over a long shelf life.

The invention is particularly adaptable to the dehydration of biologically active agents.

It is well known that biologically active materials are far more stable in dry form than they are in solution or a semi-dry state. For example, a biotic known as Ceplaothin is considered stable for 24 months in dry powder form while it is only considered stable for 6 hours at room temperature in a suitably buffered solution. Even when refrigerated, such a solution is considered stable for only about 2 days. If elevated in temperature above room temperature to any significant degree, rapid deterioration of the solution takes place in terms of loss of biological activity. Normal drying procedures such as subjecting a solution to elevated temperature frequently accompanied by air circulation is unsuitable for the drying of these biologically active materials.

A method commonly employed to overcome the stability problem is to dry the system by lyophilizing which involves freezing the solution and evaporating the water from the ice state by means of high vacuum. Thereafter it is essential that the dry material be rapidly sealed to prevent access of atmospheric moisture to the dried material.

While lyophilizing in fact does preserve the biological activity of this material, it has inherent disadvantages in that it is a slow process, it is basically a batch rather than a continuous process without the use of very sophisticated equipment.

Additionally, the structure of the residual dry material is friable and porous, and easily dislodged from the walls of the container in which it was lyophilized. This is undesirable in the case of measured quantities of biological materials which are dried in situ. It is essential for the proper functioning of such reagent trays used in determining minimal inhibitory concentrations that the active material be well adhered to its container and not dislodged due to vibration, shaking or receipt of a blow which might occur in shipment and handling.

Accordingly, the present invention provides a new method for rapidly drying liquid-solid composites and biologically active material in situ in a container. The invention provides a technique of such drying in a continuous process and in a substantially reduced time.

Briefly stated, the invention in one form thereof comprises the steps of filling a plurality of multiple well containers as disclosed in U.S. Pat. No. 3,713,895 or similar devices with any antibiotics in varying concentrations in a liquid vehicle. Trays carrying the containers are then placed on a conveyor which moves through a pre-drying housing or tunnel. The air velocity is of an order of magnitude high enough to cause vortex formation of the air in the wells, thereby resulting in a slight negative pressure in each well of the container and yet not so high as to cause the liquid to be sucked out of the cavity and dispersed into the air stream. Additionally, disposed beneath the conveyor under the drying tunnel are vibrators which subject the containers and the liquid therein to vibrations which increases the effective surface area of the liquid in each container of the liquid in the wells, while the dry air is blown over the surface of the liquid. Thereafter, the containers are introduced into a chamber where a vacuum is created to complete the drying operation and subsequently the chamber is filled with an inert gas such as nitrogen at a pressure slightly greater than atmospheric. While in the chamber the containers are sealed.

An object of this invention is to provide a new method for drying liquid-solid composites.

Another object of this invention is to provide new and improved method for drying biologically active material, and sealing the receptacles therefor to ensure a long shelf life.

A further object of this invention is to provide a new and improved method for drying biologically active materials in a plurality of containers designed to determine minimal inhibitory concentration of the material.

The features of the invention which are believed to be novel are particularly pointed out and distinctly claimed in the concluding portion of this specification. The invention, however, both as to a structural embodiment thereof and method of operation may best be appreciated together with further objects and advantages thereof by reference to the following detailed description taken in conjunction with the drawings, wherein:

FIG. 4 is a plan view of a container carrying tray which may be utilized in practice of the invention;

FIG. 5 is a sectional view seen in the plane of lines 5—5 of FIG. 4;

FIG. 6 is an enlarged elevation of a final drying and sealing unit of the apparatus of FIGS. 1 and 2; and FIG. 7 is a sectional view of a sealing sheet that may be utilized in practice of the invention.

Figures 1, 2, 3:
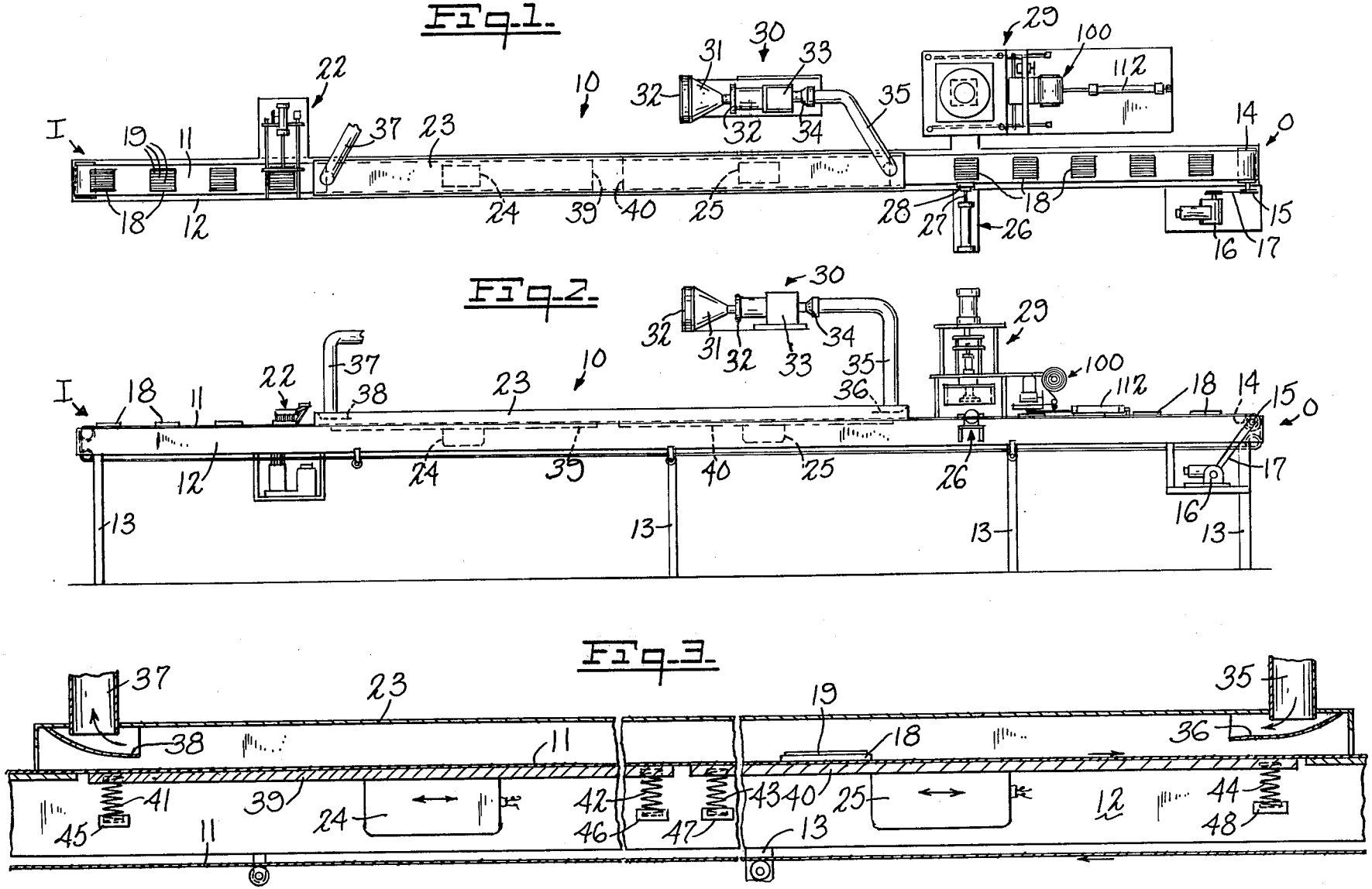
FIG. 1 is a plan view of apparatus for practicing, and embodying the invention.
FIG. 2 is an elevation of the apparatus of FIG. 1.
FIG. 3 is an enlarged view, partially cut away, of a portion of FIG. 2.

Referring first to FIGS. 1 and 2, apparatus 10 upon which the invention may be practiced may comprise a conveyor having a movable belt or webbing 11 on a supporting member such as a table 12, which is supported on legs 13. The conveyor is mounted to the supporting table on conventional supporting rollers and includes drive roller 14 having a pulley 15 thereon and driven by a motor 16 through a belt 17. Motor 16 is of the type having a shaft brake which brakes the motor shaft when the motor is de-energized.

Reference is now made to FIGS. 4 and 5, which exemplify a carrier tray 18 adapted to carry a plurality of multiple cavity or well containers 19 therein. The trays 18 are shown as having a plurality of upstanding supporting ribs **18*a*. The containers 19 each define a multiplicity of aligned wells 19*a* depending below a surrounding planar surface. Each container 19 has flanges 19*b* and 19*c* extending therefrom which rest or support ribs 18*a*. The tray 18 spaces the containers so that the wells thereof are arranged in coordinate columns and rows. The containers 19 are preferably of a type as shown in U.S. Pat. No. 3,713,985 and have interlocking means for subsequent assembly of a plurality of containers into trays containing different reagents. The containers also include legs (not shown) extending below the bottom of wells 19*a* to provide free standing support. The trays 18** may be of magnetic material. Alternatively, the trays may be of any material with a strip of magnetic material 18*b* along one or both sides thereof for reasons hereinafter made apparent.

The trays are placed on the conveyor belt at the input end I of the conveyor in predetermined spaced relation for reasons hereinafter made apparent. The conveyor belt itself may have index markings thereon to indicate the proper positioning of a tray 18.

Thereafter the trays pass a first station at which the conveyor is stopped. At this first station, is a multiple reagent dispenser 22 which may be of any type and, for example, the type disclosed in U.S. Pat. No. 3,536,449. Such multiple reagent dispenser is arranged to fill the wells 19*a* in the trays with predetermined concentrations of a reagent in a buffering solution. The successive wells of each container may be filled with concentrations in a binary, quaternary or any multiple relationship. A multiple dispenser is indexed over coordinately arranged columns and rows of wells, and places predetermined concentrations of reagent in each row (or column) of wells.

Upon filling of the trays, the conveyor is then restarted and carries the trays into an elongated pre-drying housing or tunnel 23 where ambient or gently warmed air is blown over the surface of the solution in the tray wells. Disposed beneath the conveyor belt are vibrators 24 and 25 preferably of the electromechanical type which impart small vibrations to trays and hence the solution therein. Such vibrations effectively multiplies the surface area of the solution in the wells and preferably creates standing waves in the liquid. It will be understood that the movement of the trays through the tunnel 23 is intermittent as the conveyor is stopped for filling of successive trays. Therefore, the intermittent movement of Conveyor 11 will simultaneously present trays at the filling station, over the vibrators and at a final drying position.

As the trays 18 exit from the tunnel, the conveyor is stopped while the tray is adjacent a transfer member in the form of a cylinder-piston assembly 26. The piston 27 has at the end thereof a magnetic chuck 28 which is energized and which pushes the tray with the containers thereon into a final drying and sealing assembly 29.

When the final drying and sealing steps have been completed, the piston engages the tray, withdraws it from assembly 29 back onto the conveyor and the sealed trays are then transferred to the output end 0 of the conveyor.

An apparatus 30 provides warm dryed air to drying tunnel 23. Such apparatus 30 includes a dehumidifier 31 having a first filter 32 at the input thereof, a second filter 32 followed by an axial flow fan 33 and finally a heating element 34. The air thus dried is passed through a conduit 35 into tunnel 23 above a directional baffle 36 positioned to give sufficient clearance therebelow for the trays and containers. Warming of the air is optional and the temperature is kept to approximately 65° C or below. At the opposite end of tunnel 23 is an outlet conduit 37 positioned above another directional baffle 38 in tunnel 23.

With this arrangement, as trays 18 with containers 19 move through tunnel 23, dry air passes over the enlarged effective surface area off the liquid in each well and rapidly evaporates the liquid.

The vibrators 24 and 25 are of any suitable type, preferably electromechanical, and as shown in FIG. 4 are mounted to plates 39 and 40, respectively. Plates 39 and 40 are supported on springs 41, 42, 43 and 44. The springs 41–44 are seated on retainers 45–48, respectively, which may be secured to table 12.

Final drying and sealing assembly 29 is more clearly shown in elevation and partly in section in FIG. 6, and comprises a base member 60, having an opening therein 61, connectable to a vacuum creating means, and a further opening 62 for the introduction of an inert atmosphere such as dry sterile nitrogen or argon.

The upper surface of base 60 resides in the same horizontal plane as conveyer 11 so that a tray 18 thereon may be pushed to base 60 from conveyor 11 and then pulled back from base 60 on member 11. For this purpose the electromagnet 28 (FIG. 1) is provided on the end of piston 27. Disposed above base member 60 in fixed relation thereto is a support member 64 which is spaced and supported by a plurality of upright members 65 (only two shown). Supported above member 64 is a further stationary member 66 which is supported on a plurality of rigid upright members 67 (only two shown).

Mounted to support member 66 is a cylinder 68 having a piston 69 connected to and adapted to move an assembly 70. Assembly 70 comprises a second cylinder 71 having a piston 72 double ended and 72*a*. Piston rod 72*a* is connected to an anti-rotation plate 73 slidable on rods 67. Cylinder 71 is secured to a mounting plate 75 at the end of rods 74. Secured to the lower side of support 75 is a mounting member 76 having secured thereto at the lower portion thereof a hollow chamber defining member 77. Chamber defining member 77 has an upper wall 78 and a side wall 79, preferably circular in shape. Defined in plate 60 is a groove 80 having a sealing member 81 therein. The lower edges 82 of chamber member 77 are adapted to be moved down into grooves 80 and provide an air-tight chamber above plate 60 and about a tray 18. Member 77 is lowered into an operative position by cylinder 68.

The piston 72 of cylinder 71 extends through mounting member 76 into a somewhat flexible member 84, which carries a sealing member 85. Sealing member 85 comprises a platen 86 having at the lower end thereof a resilient rubber or plastic magnetized sheet 87. Sheet 87 may contain barium ferrite or other suitable permanently magnetizable material. A heating coil indicated by the reference numeral 88 is also carried on or may be embedded in platen 86.

Cylinder 71 may move independently of cylinder 68 to place a seal over the containers in tray 18 while the chamber member 77 is down in an operative position on base 60.

In operation and assuming that a seal has been placed on and is magnetically held on sealing member 85, when a tray 18 is introduced onto plate 60 cylinder 68 is actuated to move assembly 70 and chamber member 77 down into the grooves 80 on plate 60 thus creating an air-tight chamber. A vacuum pump is then energized to produce a high vacuum on the order of about 500 microns in the chamber. This removes any residual moisture in the containers and also any airborne contaminants, as well as essentially eliminating oxygen from the containers. Thereafter, an inert gas of a type previously stated is introduced through port 62 into the chamber to create an inert atmosphere at a pressure slightly above normal atmospheric pressure. Then cylinder 71 is actuated to lower sealing member 85 into pressure contact with the top of containers 19. The sealing material is heat sensitive. The heat sealable surface is heated by platen 85 and upon contact and pressure adheres to containers 19.

The sealing bond between the containers 19 and the seal is sufficient to overcome the magnetic attraction between the sealing strip and the rubber-magnet composite sheet 86. Sealing member 85 is retracted by piston 72 and then cylinder 68 is operated to raise chamber member 77, tray 18 is moved back onto conveyer 11 and the conveyer is stepped to present another tray to sealing assembly 29.

A section of the laminated sealing sheet 89 is shown in FIG. 7, and comprises a lower heat sensitive tape 90, carried by a polyester backing 91, the next layer 92 is a magnetic film either coated onto polyester backing 91 or a pressure sensitive polyester film magnetic tape and then an upper metalized polyester film 93 to insure a good vapor barrier. Alternately, the magnetic layer may be on top. These four layers are laminated together to form the sealing member or sheet. The sheet 89 may have breakaway cuts or perforations in rows therein so that the plurality of containers in the tray may be later easily separated.

In the alternative the lower layer of the sealing strip may be of a pressure sensitive material which will adhere upon contact and pressure by sealing member 85. In such case the heating coil would not be required on the platen.

The sealing is preferably done at a pressure slightly greater than atmospheric, preferably in the order of 0.05 to 0.15 $Kg/cm^2$, to provide a visual check on the integrity of the seal. With the pressure in the wells of containers 19 at slightly greater than atmospheric pressure, there will be a doming effect of the sealing layers 89 over the wells as indicated at D in FIG. 5. So long as these domes are visible and will recover after slight finger pressure it can be easily determined that the seals over the wells have not lost their integrity, and the wells contain only the agent and an inert atmosphere.

The assembly 29 includes a sealing sheet delivery means 100. Delivery means 100 moves the seal sheet from a reel 101 to a position where a severed section is picked up by sealing member 85. The sealing sheets in web form passes through a pair of rollers 102, one of which is powered by a motor 103, over a feed table 104 to a movable table 105. When the edge of the strip is sensed by a detector 106 which may be of the photosensitive type, motor 103 is halted, and a rotary knife 107 driven by a motor 108 moves across the strip on guideway 109 to sever a sealing sheet 89. The sheet 89 is then on table 105, which is movable on guides 110 straddling chamber member 77 to a position below sealing member 86, as shown in broken line, sealing member 86 comes down and magnetically picks up sheet 89, and table 105 is withdrawn to the position shown in full line. Table 105 is moved on guides 110 by the piston 111 of a cylinder 112, mounted to base member 60.

Sealing sheets 89 are held on table 105 by suction derived from apertures 113 therein communicating with a plenum in table 105. If pressure sensitive material is used, a slight air stream is directed through apertures 113 to enable it to feed onto table 105. This air feed is again actuated to free the film and enable magnetic sheet 87 to pick up the sealing film.

The containers, while shown in a preferred form may take any suitable configuration, but are preferably circular.

The containers should have a diameter which is substantially no greater than the depth of the container. The velocity of the air in tunnel 23 is selected to produce the desired vortex action in the containers or wells of the illustrated containers without removing the composite from the containers. The velocity should be high enough to cause turbulence at the edge of each of the containers or wells **19*a* if containers 19** are used.

Experience has shown that where the drying air velocity is high enough and the vortex created sufficiently violent, the liquid at the bottom of the wells will roll or move along a spiral path up the wall of the well and be carried away by the air stream. To avoid excessive vortex formation, it is desirable to keep the mass velocity of the air above the containers in the range of 10 to 20 feet per second for wells **19*a* about 5/16** inch in diameter and ⅜ inches deep. The velocity may differ for different size containers.

Where the vibrations are utilized a frequency of 3600 cycles/minute is satisfactory. The amplitude of vibration is adjusted until a wave pattern is created. This may be checked visually. At the stated vibration frequency, an air temperature of 50° C, and an air velocity of about 20 feet per second, water was evaporated from containers 19 in approximately 9 minutes. The volume was 20 microliters per well. The imparted vibrations approximately doubled the exposed surface of the liquid. The drying air may be used at ambient temperature provided that the air has been dried to a saturation point below the temperature employed. At an air temperature of 25° C to 27° C the drying time was approximately 10 minutes, where the liquid volume was 20 microliters.

Since this drying time is short in relation to the stability time of the most unstable antibiotics, such as Cephalethin, it becomes permissable to use elevated temperatures of drying air. Tests at 50° C have resulted in drying times of approximately 5 minutes for a 10 microliter volume.

The drying tunnel deflectors 36 are preferrably four or five times as long as the height of the tunnel above the conveyor to direct and smooth out the air flow. The deflectors 36 should be slightly above the top of the containers to prevent high velocity impingement against the front edge of the containers.

More energy may be put into the second vibrator 25 than vibrator 24, because the active material has become smaller in volume and is approaching dryness.

The invention provides dry, positively sealed containers of biologically active material which is not friable and well adhered to the wall of the container in which it is dried.

It may thus be seen that the objects of the invention set forth as well as those made apparent from the foregoing description are efficiently attained. While preferred embodiments of the invention have been set forth for purposes of disclosure, modification to the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

What is claimed is:

1. A method of drying liquid from a liquid-solid composite in a round container comprising the step of directing a relatively high velocity stream of dry air over said container in a housing substantially parallel to the surface of the liquid in said container to create a vortex in said container and reduce the pressure in said container while maximizing the area of the exposed liquid to thereby evaporate the liquid from said container.

2. The method of claim 1 further comprising vibrating said container to produce a wave pattern in the liquid simultaneously with the passage of air thereover.

3. A method of drying moisture from a biologically active liquid-solid composite which comprises the steps of filling a container with the composite, subjecting said container to vibration to increase the effective surface area of liquid therein, directing dry air over the liquid substantially parallel to the surface of the liquid in said container while it is subjected to vibration, and thereafter subjecting the container to a vacuum.

4. The method of claim 3 including the further step of subjecting the container to an inert atmosphere at a pressure slightly greater than normal atmospheric pressure, and sealing said container in the inert atmosphere.

5. A method of sealing a dry biologically active substance in a container where the container has a surface surrounding a well in which the substance resides, comprising the steps of subjecting said container to a vacuum in a chamber, then pressuring said chamber with an inert gas slightly above atmospheric pressure, adhering flexible sealing sheet to said surface, and removing said container from said chamber.

6. The method of claim 5 where said container comprises a plurality of aligned wells depending from an upper planar surface.

7. A method of drying moisture from a biologically active liquid-solid composite which comprises the steps of filling a round container with the composite, subjecting said container to vibration to increase the effective surface area of liquid therein, directing dry air over the liquid substantially parallel to the surface thereof while it is subjected to vibration, thereafter subjecting the container to a vacuum, and sealing said container.

8. The method of claim 7 including the further step of subjecting the container to an atmosphere of an inert gas prior to sealing said container whereby the container is sealed with inert gas therein.

9. A method of sealing a dry biologically active substance in a container where the container has a surface surrounding a well in which the substance resides, comprising the steps of subjecting said container to a vacuum in a chamber, then introducing as inert gas into said chamber, adhering a flexible sealing sheet to said surface, and removing said container from said chamber.

10. A method of drying liquid from a liquid-solid composite in a round container comprising the steps of providing said container with the composite therein, providing an elongated housing member, moving said container along the length of said housing member while directing a relatively high velocity stream of dry air through said housing member substantially parallel to the surface of the liquid over said container in said housing to create a vortex in said container and reduce the pressure therein while maximizing the area of exposed liquid to thereby evaporate the liquid from said container.

11. The method of claim 10 including the further step of vibrating said container in said housing.

12. The method of claim 11 comprising the further step of introducing said container to an atmosphere of a gas of less than atmospheric pressure upon exit from said housing, and sealing said container.

13. The method of claim 16 including the further step of subjecting the container to an atmosphere of an inert gas prior to sealing said container whereby the container is sealed with inert gas therein.

14. The method of claim 13 wherein said container comprises a tray having a multiplicity of round wells therein with a common surface surrounding said wells, said wells containing said composite.

15. The method of claim 14 comprising the further step of applying a single sealing member to said common surface to seal all of said multiplicity of wells.

* * * * *

UNITED STATES PATENT AND TRADEMARK OFFICE

CERTIFICATE OF CORRECTION

PATENT NO. : 4,063,367

DATED : December 20, 1977

INVENTOR(S) : LEON TALALAY

It is certified that error appears in the above-identified patent and that said Letters Patent are hereby corrected as shown below:

The Title should read as follows --METHOD OF DRYING LIQUID FROM A LIQUID-SOLID COMPOSITE--.

Column 6, line 38, after "air flow" insert --substantially parallel to the surface of the liquid--.

Column 7, line 7 of claim 5, before "flexible" insert --a--.

Column 8, line 5 of claim 9, "introducing as" should read --introducing an--.

Column 8, line 1 of claim 13, "claim 16" should read --claim 12--.

Signed and Sealed this

*Twenty-eighth* Day of *March 1978*

[SEAL]

*Attest:*

RUTH C. MASON
*Attesting Officer*

LUTRELLE F. PARKER
*Acting Commissioner of Patents and Trademarks*